US005261530A

United States Patent [19]

Marco

[11] Patent Number: 5,261,530

[45] Date of Patent: * Nov. 16, 1993

[54] CARRIER STOCK WITH TEAR-OPEN TABS

[75] Inventor: Leslie S. Marco, Bloomingdale, Ill.

[73] Assignee: Illinois Tool Works Inc., Glenview, Ill.

[ * ] Notice: The portion of the term of this patent subsequent to Aug. 18, 2009 has been disclaimed.

[21] Appl. No.: 855,419

[22] Filed: Mar. 23, 1992

Related U.S. Application Data

[63] Continuation of Ser. No. 679,520, Apr. 2, 1991, Pat. No. 5,139,137, which is a continuation-in-part of Ser. No. 537,674, Jun. 14, 1990, Pat. No. 5,020,661.

[51] Int. Cl.[5] ..... B65D 75/62

[52] U.S. Cl. ..... 206/150; 206/151; 294/87.2

[58] Field of Search ..... 206/139, 145, 147, 148, 206/149, 150, 151-158, 169, 161; 294/87.2

[56] References Cited

U.S. PATENT DOCUMENTS

| | | | |
|---|---|---|---|
| 2,997,169 | 8/1961 | Poupitch | 206/150 |
| 3,038,602 | 6/1962 | Rapata | 206/150 |
| 3,084,792 | 4/1963 | Poupitch | 206/150 |
| 3,086,651 | 4/1963 | Poupitch | 206/150 |
| 3,504,790 | 4/1970 | Owen | 206/150 |
| 3,721,337 | 3/1973 | Braun et al. | 206/150 |
| 4,018,331 | 4/1977 | Klygis | 206/150 |
| 4,064,989 | 12/1977 | Olsen | 206/428 |
| 4,109,787 | 8/1978 | Klygis et al. | 206/150 |
| 4,219,117 | 8/1980 | Weaver et al. | 206/150 |
| 4,925,020 | 5/1990 | Gordon | 206/150 |

*Primary Examiner*—Jimmy G. Foster

*Attorney, Agent, or Firm*—Dressler, Goldsmith, Shore, Sutker & Milnamow, Ltd.

[57] ABSTRACT

Carrier stock formed from a single sheet of resilient polymeric material, such as low density polyethylene, for machine application to substantially identical containers. The stock is severable to form individual carriers with three longitudinal rows of container-receiving apertures, as defined by band segments, which include cross segments formed with tear-open tabs. The cross segments formed with such tabs are slitted so as to define a series of frangible bridges, which are staggered transversely, and which can be easily torn by a user pulling on such tabs. Also, a distal portion of each tab is connected to another band segment by a frangible web, which is slitted.

6 Claims, 2 Drawing Sheets

CARRIER STOCK WITH TEAR-OPEN TABS

CROSS-REFERENCE TO RELATED APPLICATION

This application is a continuation of application Ser. No. 07/679,520, filed Apr. 2, 1991, now U.S. Pat. No. 5,139,137, which is a continuation-in-part of U.S. Ser. No. 07/537,674 which is incorporated herein by reference.

TECHNICAL FIELD OF THE INVENTION

This invention pertains to carrier stock for machine application to substantially identical containers. This invention pertains, more particularly, to carrier stock that is severable to form individual carriers with separate apertures to receive the individual containers. Tear-open tabs are provided, which are disposed so as not to interfere with jaw placement during machine application.

BACKGROUND OF THE INVENTION

Typically, carrier stock with individual container-receiving apertures for machine, application to substantially identical containers is formed, as by die-cutting, from a single sheet of resilient polymeric material. An example of such carrier stock having band segments defining three longitudinal rows of container-receiving apertures is disclosed in Klygis U.S. Pat. No. 4,018,331. Another example is disclosed in Weaver et al. U.S. Pat. No 4,219,117.

Various attempts have been made to provide such carrier stock with tear-open capability. An example is disclosed in Olsen U.S. Pat. No. 4,064,989. As disclosed therein, outer band segments of such carrier stock are formed with tear-open tabs.

Improved carrier stock with tear-open capability is disclosed in U.S. patent application Ser. No. 07/537,674, supra. Each outer segment of the improved carrier stock disclosed therein is formed with a tear-open tab extending in a generally transverse direction, preferably into one of the can-receiving apertures of such stock, when the stock is unstressed. The improved carrier stock disclosed therein offers significant advantages over previously known carrier stock with tear-open capability.

Typically, in machine application of such carrier stock, separable jaws engage outer band segments of the carrier stock, so as to stretch the band segments defining the container-receiving apertures as such stock is applied to the individual containers. If tear-open tabs extend from such outer segments, however, it is possible for such tabs to interfere with proper placement of the jaws against such outer segments. It would be highly desirable if carrier stock could have substantially comparable tear-open capability without having tear-open tabs extending from outer band segments.

As a matter of further background, improved carrier stock having band segments defining three longitudinal rows of container-receiving apertures is disclosed in U.S. patent application Ser. No. 07/519,859 filed May 7, 1990, and assigned commonly herewith, for "Carrier Stock with Band Segments Extending between Opposite Edges." As disclosed therein, the improved carrier stock can have integral handles along longitudinal edges of the individual carriers.

SUMMARY OF THE INVENTION

This invention provides carrier stock formed from a single sheet of resilient polymeric material, such as low density polyethylene, for machine application to substantially identical containers. Such stock is severable to form individual carriers, which are configured to include tear-open tabs enabling the containers to be easily removed but not interfering with jaw placement during machine application. Each individual carrier has separate apertures to receive the individual containers.

The stock is formed with band segments defining the separate apertures. Such segments include outer segments extending in a generally longitudinal direction when the stock is unstressed, inner segments extending in a generally longitudinal direction when the stock is unstressed, and cross segments extending in a generally transverse direction when the stock is unstressed.

The stock is formed with a tear-open tab associated with each of the separate apertures. Each tab extends from one of the cross segments into an associated one of the separate apertures. Each tab extends in a generally longitudinal direction when the stock is unstressed. The stock is slitted so as to define a series of frangible bridges in each cross section having such a tab extending therefrom. The frangible bridges facilitate tearing of the cross segments having such bridges so as to facilitate removal of the individual containers. Because the tabs extend from cross segments, rather than from outer segments, the tabs do not interfere with jaw placement during machine application of the stock.

Preferably, the stock is slitted so as to define a series of slits in each cross segment having such a tab extending therefrom, such slits extending in a generally transverse direction when the stock is unstressed. Such slits define the series of frangible bridges. Preferably, moreover, such slits and such bridges are staggered transversely when the stock is unstressed.

Each tab has a proximal portion where such tab adjoins one of the cross segments and a distal portion.

It is preferred that each tab is connected at its distal portion to one of the inner segments by a frangible web of the stock when the stock is unstressed. The frangible webs facilitate winding and handling of the carrier stock, without tangling, before the frangible webs are broken.

Each frangible web may be advantageously slitted so as to weaken such web. Each tab may extend at an acute angle relative to a truly longitudinal direction with its distal portion nearer to the inner segment connected thereto by one of the frangible webs.

Preferably, the separate apertures are arranged in three longitudinal rows, namely two outer rows and a middle row, and in plural transverse ranks. Preferably, moreover, the tab associated with each aperture in one of the outer rows and the tab associated with each aperture in the middle row, in each transverse rank, are connected at their distal ends to a common one of the inner segments by such frangible webs.

In a preferred arrangement, in which each tab extends at an acute angle relative to a truly longitudinal direction, and in which each tab is connected at its distal portion to one of the inner segments by a frangible web, each tab and the frangible web connecting such tab to one of the inner segments divide the segment having such web extending thereinto into a first region and a second region. The first region has a crotch, which is bounded partly by the proximal portion of such tab, and which opens generally at an acute angle. The slits are staggered such that an imaginary line bisecting the slits extends generally in a straight line, which generally bisects the crotch. Thus, when such tab is pulled by a user, the frangible bridges tend to be successively torn from a starting point at the crotch, through the cross segment having such tab extending therefrom.

These and other objects, features, and advantages of this invention are evident from the following description of a preferred embodiment of this invention with reference to the accompanying drawings.

DETAILED DESCRIPTION OF PREFERRED EMBODIMENT

Figure 1:
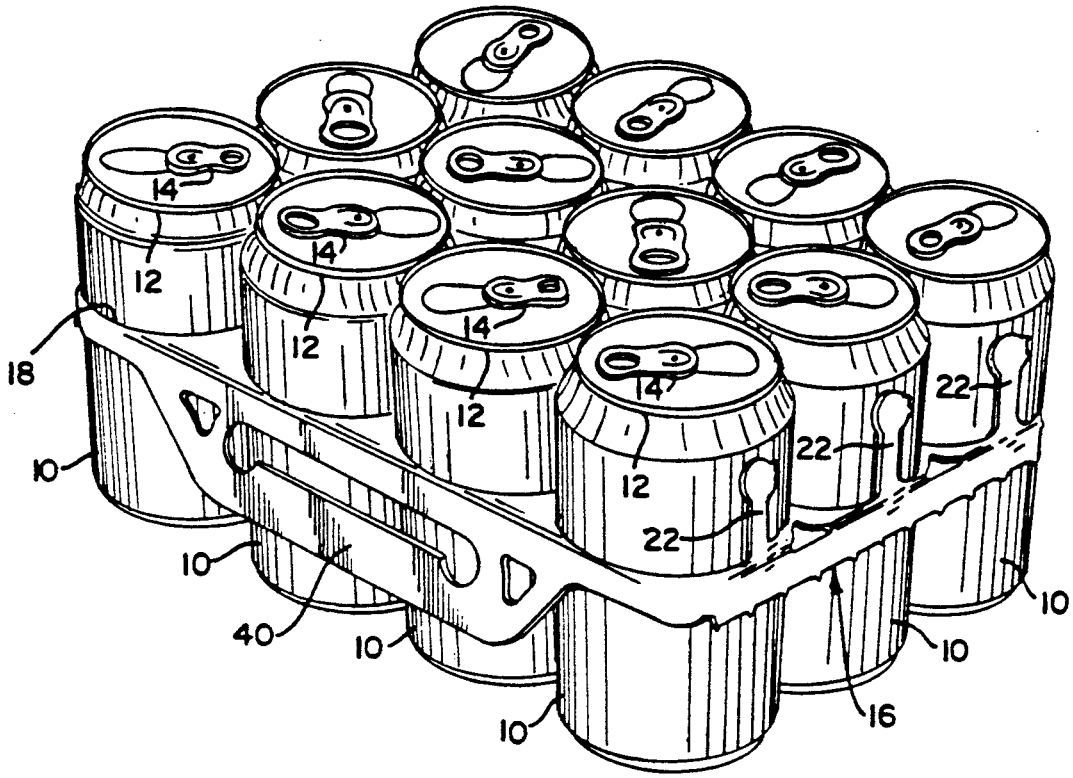
FIG. 1 is a perspective view of a package comprising twelve substantially identical cans and a carrier, which is severed from carrier stock according to this invention.
Figure 3:
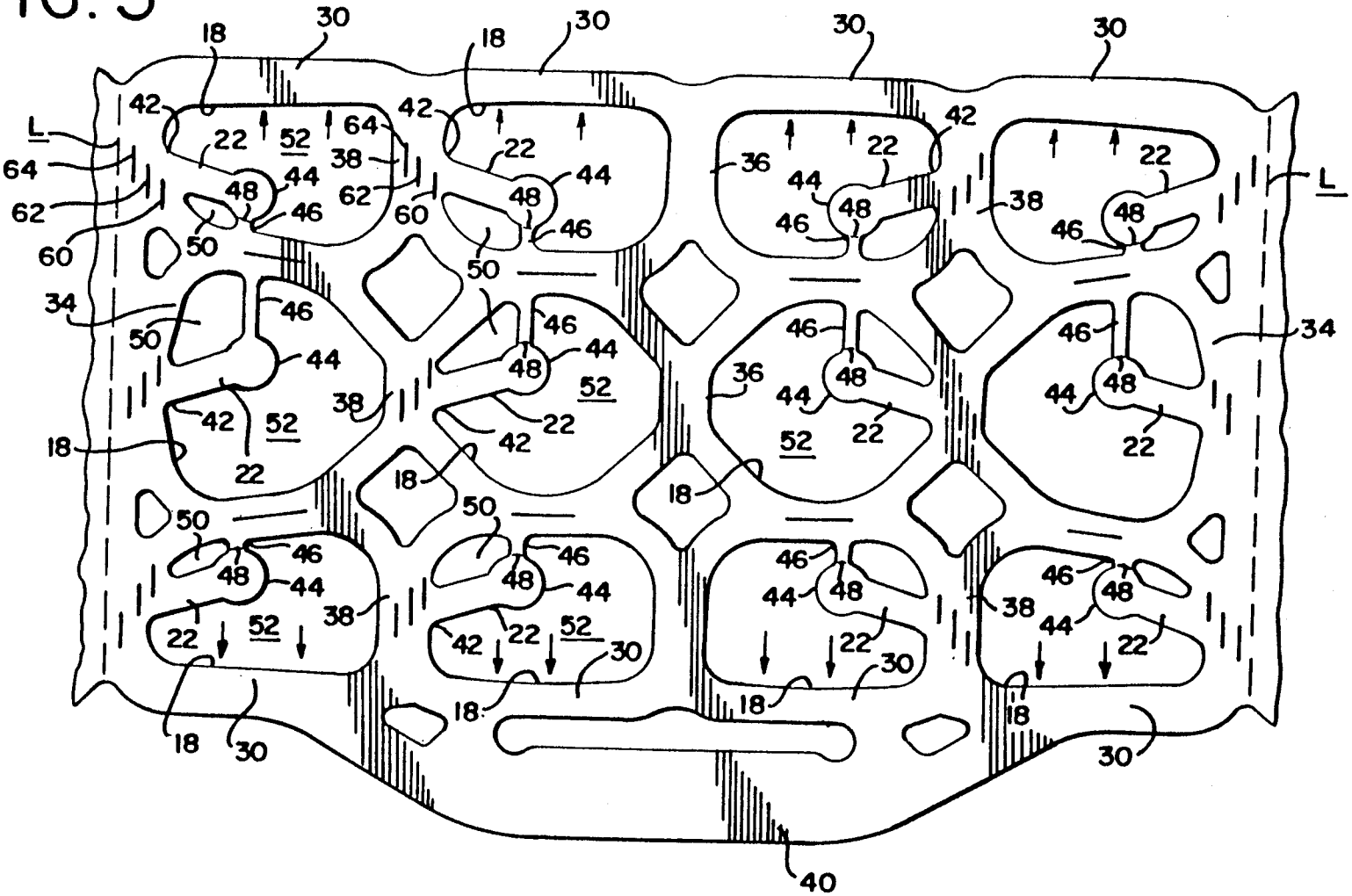
FIG. 3, on a smaller scale compared to FIG. 2, is a fragmentary, plan view of one such carrier shown completely and two adjoining carriers shown fragmentarily, in carrier stock according to this invention.

In FIG. 1, a package is shown, which comprises twelve substantially identical cans 10, each having a chime 12 and a pull tab 14 at one end, and a carrier 16. ,The carrier 16 has individual apertures 18 to receive the individual cans 10, in a rectangular array, which has three longitudinal rows and four transverse ranks. As shown in FIG. 3, the carrier 16 is severable from carrier stock 20 constituting a preferred embodiment of this invention, along perforated lines L which extend transversely when such stock 20 is unstressed. As described below, the carrier stock 20 has tear-open tabs 22, which enable the cans 10 to be easily removed but which do not interfere with jaw replacement during machine application.

As shown in FIG. 1, the cans 10 are beverage cans of a type used commonly for beer, soft drinks, and other beverages. This invention is not limited, however, to usage with such cans but is useful with cans, bottles, and other containers of various types.

Although the carrier 16 is shown to be downwardly spaced from the chimes 12, along the side walls of the cans 10, this invention is not limited to such a location on the cans 10. This invention contemplates that the carrier 16 may be directly beneath to the chimes 12.

The carrier stock 20 is formed in an indeterminate length, as by die-cutting, from a single sheet of resilient polymeric material. A preferred material is low density polyethylene. A preferred thickness for such stock 20 in an unstressed condition, if low density polyethylene is used, in about 16 mils.

Except for the tear-open tabs 22, which are described below, the carrier stock 20 is similar to carrier stock disclosed in U.S. patent application Ser. No. 07/519,859, filed May 7, 1990, and assigned commonly herewith, for "Carrier Stock with Band Segments Extending between Opposite Edges," the disclosure of which is incorporated herein by reference.

The carrier stock 20 is formed with integrally joined band segments defining the separate apertures 18. These segments include outer segments 30 extending in a generally longitudinal direction when the carrier stock 20 is unstressed, inner segments 32 extending in a generally longitudinal direction when the carrier stock 20 is unstressed, and cross segments extending in a generally transverse direction when the carrier stock 20 is unstressed. The cross segments includes cross segments 34 extending between opposite edges of the carrier stock 20 and being severable transversely along the perforated lines L. cross segments 36 bisecting each carrier 16, and cross segments 38 between the cross segments 34 and the cross segments 36. The carrier stock 20 is formed with an integral handle 40 for each carrier 16. Further details of the band segments defining the separate apertures 18 and of the integral handles 40 (one shown) are found in U.S. patent application Ser. No. 07/519,859, supra.

As shown in FIG. 3, the apertures 18 of the outer longitudinal rows are generally elongated in the direction of the rows, i.e., in a longitudinal direction.

Each tab 22 extends from one of the cross segments 34 extending between opposite edges of the carrier stock 20, or from one of the cross segments 38 between the cross segments 34 and the cross segment 36 bisecting each carrier 16, into one of the can-receiving apertures 18. Each tab 22 extends in a generally longitudinal direction, but at an acute angle relative to a truly longitudinal direction, when the carrier stock 20 is unstressed.

Each tab 22 has a proximal portion 42 where such tab 22 adjoins one of the cross segment 34, 38, and a distal portion 44. Each tab 22 is connected to one of the inner segments 32 by a frangible web 46, which is slitted so as to define a generally longitudinal slit 48 weakening the frangible web 46, when the carrier stock 20 is unstressed.

As shown, the tab 22 for each aperture 18 in one of the outer rows, namely the outer row opposite to the integral handle 40 of each carrier 16, and the tab 22 for each aperture 18 in the middle row are connected, in each transverse rank, to a common one of the inner segments 32 by such webs 46. The frangible webs 46 extend in a generally transverse direction when the carrier stock 20 is unstressed and vary in their lengths so as to accommodate the varying shapes among the can-receiving apertures 18, as shown. The frangible webs 46 are adapted to break if and when the carrier stock 20 is applied to the respective cans 10 along the side walls of the cans 10. The frangible webs 46 may remain unbroken, however, if and when carrier stock 20 is applied so as to be directly beneath to the chimes 12. The frangible webs 46 facilitate winding and handling of the carrier stock 20, without tangling, before such webs 46 are broken.

Each tab 22 and the frangible web 46 connecting such tab 22 to one of the inner segments 32 divide the aperture 18 having such tab 22 extending thereinto into a first, minor region 50 and a second major region 52. As exemplified in FIG. 2, the first, minor region 50 has a relatively narrow crotch 54, which is bounded partly by the proximal portion 42 of such tab 22.

The carrier stock 20 is slitted so as to define a series of slits 60, 62, 64, in each of the cross segments having such a tab 22 extending therefrom, namely in each of the cross segments 34 and each of the cross segments 38. The cross segments 36 bisecting each carrier 16 are not slitted. Such slits 60, 62, 64, are staggered transversely, in such manner that an imaginary line bisecting such slits 60, 62, 64, extends generally in a straight line, which generally bisects the relatively narrow crotch 54 that is bounded partly by the proximal portion 42 of the tab 22 extending from the cross segment having such slits 60, 62, 64. As exemplified in FIG. 2, slits 60, 62, 64, define a series of frangible bridges 70, 72, 74, 76, which are staggered transversely, in each of the cross segments having such slits 60, 62, 64.

When the carrier stock 20 is applied to the cans 10, a machine (not shown) is used, such as the machine disclosed in Klygis U.S. Pat. No. 4,018,331. Other machines known in the art may be alternatively used. Such a machine employs spreadable jaws (not shown) which apply lateral stretching forces to the carrier stock 20, at the outer segments 30, as and where suggested by broad arrows in FIG. 3. Because the tear-open tabs 22 extend from cross segments of the carrier stock 20, not from any of the outer segments 30, such tabs 22 do not interfere with jaw placement during application of the carrier stock 20 by such a machine.

In a package, such as the package shown in FIG. 1, when each tab 22 is pulled by a user, the frangible bridges 70, 72, 74, 76, in the cross segment having such tab 22 extending therefrom tend to be successively torn from a starting point at the crotch 54 bounded partly by the proximal portion 42 of such tab 22, through the cross section having such tab 22 extending therefrom. Thus, each cross segment having such a tab 22 extending therefrom can be readily torn, whereby each can 10 can be readily removed from the package.

Figure 2:
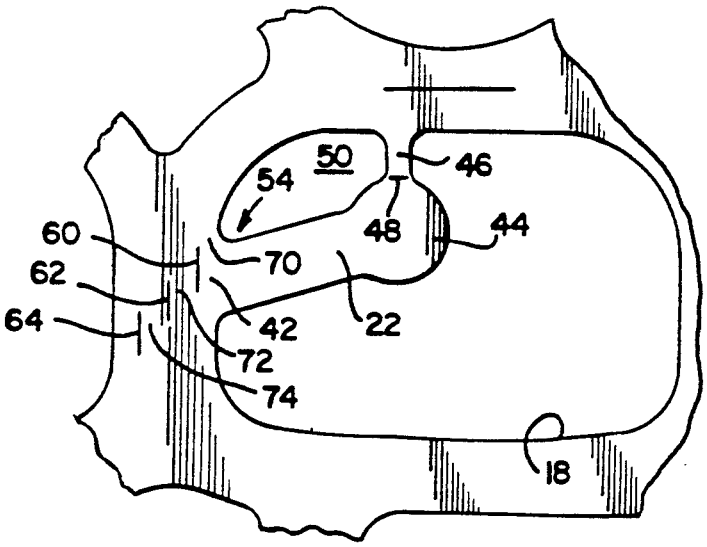
FIG. 2 is an enlarged, fragmentary detail showing a representative one of a plurality of tear-open tabs characteristic of carrier stock according to this invention, before such stock is applied to the containers.

As shown in FIGS. 2 and 3, the frangible bridges in the series associated with each tab 22 are aligned to start at a point adjacent one extremity of the base of such tab 22 and to extend downwardly and away from that extremity, so that such tab 22, when pulled, will sever the band segment having such tab 22 extending therefrom. Inherently, because the band segment having such tab 22 extending therefrom has a single series of frangible bridges associated with such tab 22, such tab 2 will remain on the carrier 16 as an integral element.

Various modifications may be made in the carrier stock disclosed herein without departing from the scope and spirit of this invention.

I claim:

1. Carrier stock for machine application to substantially identical containers, said stock being formed from a single sheet of resilient polymeric material and being severable to form individual carriers with separate apertures to receive the individual containers, said stock having a plurality of longitudinal rows of said apertures and a plurality of transverse ranks of said apertures with an outer row of said apertures being generally elongated in the direction of the rows, said stock being formed with integrally joined band segments defining the separate apertures, said segments including outer segments extending in a generally longitudinal direction when said stock is unstressed, the generally longitudinal direction corresponding to the direction in which said apertures of the outer row are elongated, inner segments extending in a generally longitudinal direction when said stock is unstressed, and cross segments extending in a generally transverse direction when said stock is unstressed, said stock being formed with an integral tab for each of the separate apertures arranged in said rows, each tab extending from one of the cross segments into one of the separate apertures arranged in said rows, each tab extending in a generally longitudinal direction when said stock is unstressed, said stock being slitted so as to define a series of frangible bridges in each cross segment having such a tab extending therefrom.

2. The carrier stock of claim 1 wherein said stock is slitted so as to define a series of slits in each cross segment having such a tab extending therefrom, said slits extending in a generally transverse direction when said stock is unstressed, said slits defining the series of frangible bridges.

3. The carrier stock of claim 2 wherein said slits and said bridges are staggered transversely when said stock is unstressed.

4. Carrier stock for machine application to substantially identical containers, said stock being formed from a single sheet of resilient polymeric material and being severable to form individual carriers with separate apertures arranged in longitudinal rows and transverse ranks to receive the individual containers, each of the separate apertures to receive a single one of the individual containers, said stock being formed with integrally joined band segments defining the separate apertures, said segments including outer segments extending in a generally longitudinal direction when said stock is unstressed, inner segments extending in a generally longitudinal direction when said stock is unstressed, and cross segments extending in a generally transverse direction when said stock is unstressed, said stock being formed with a separate, integral tab for each of the separate apertures of each of the individual carriers, each tab having a base and extending from one of the band segments defining the separate apertures, into one of the separate apertures, toward an adjoining one of the band segments defining the separate apertures, each band segment having such a tab extending therefrom being slitted to define a single series of frangible bridges aligned to start at a point adjacent one extremity of the base of the tab and to extend downwardly and away from said extremity, so that the tab, when pulled, will sever such band segment and will remain on the carrier as an integral element.

5. The carrier stock of claim 4 wherein each tab extends from one of the cross segments into one of the separate apertures in a generally longitudinal direction when said stock is unstressed.

6. The carrier stock of claim 5 wherein each tab extends at an acute angle relative to a truly longitudinal direction.

* * * * *